US008539934B2

(12) United States Patent
Kaneko

(10) Patent No.: US 8,539,934 B2
(45) Date of Patent: Sep. 24, 2013

(54) INJECTION ABNORMALITY DETECTION METHOD AND COMMON RAIL FUEL INJECTION CONTROL SYSTEM

(75) Inventor: Hirotaka Kaneko, Saitama (JP)

(73) Assignee: Bosch Corporation, Tokyo (JP)

( * ) Notice: Subject to any disclaimer, the term of this patent is extended or adjusted under 35 U.S.C. 154(b) by 558 days.

(21) Appl. No.: 12/937,097

(22) PCT Filed: Apr. 9, 2009

(86) PCT No.: PCT/JP2009/057239

§ 371 (c)(1),
(2), (4) Date: Oct. 8, 2010

(87) PCT Pub. No.: WO2009/125807

PCT Pub. Date: Oct. 15, 2009

(65) Prior Publication Data

US 2011/0030655 A1 Feb. 10, 2011

(30) Foreign Application Priority Data

Apr. 10, 2008 (JP) ..... 2008-102825

(51) Int. Cl.
*F02M 63/00* (2006.01)
*F02M 59/36* (2006.01)

(52) U.S. Cl.
USPC ..... 123/458; 123/447

(58) Field of Classification Search
USPC ..... 123/446, 447, 457, 458; 701/102–105, 701/114–115
See application file for complete search history.

(56) References Cited

U.S. PATENT DOCUMENTS

| | | | | |
|---|---|---|---|---|
| 5,727,515 | A * | 3/1998 | Biester | 123/198 D |
| 6,234,148 | B1 * | 5/2001 | Hartke et al. | 123/447 |
| 6,253,734 | B1 * | 7/2001 | Rembold et al. | 123/446 |
| 6,283,108 | B1 * | 9/2001 | Matsufuji et al. | 123/690 |
| 6,715,470 | B2 * | 4/2004 | Takahashi | 123/458 |
| 7,137,294 | B2 * | 11/2006 | Eser et al. | 73/114.51 |
| 7,240,667 | B2 * | 7/2007 | Dolker | 123/456 |
| 7,278,405 | B2 * | 10/2007 | Takahashi | 123/514 |
| 7,431,018 | B2 * | 10/2008 | Tsujimoto | 123/446 |
| 7,596,447 | B2 * | 9/2009 | Oono | 701/114 |

(Continued)

FOREIGN PATENT DOCUMENTS

| | | | |
|---|---|---|---|
| JP | 61229932 | A | 10/1986 |
| JP | 2002106400 | A | 4/2002 |

(Continued)

*Primary Examiner* — Thomas Moulis
(74) *Attorney, Agent, or Firm* — Michael Best & Friedrich LLP

(57) ABSTRACT

To reliably detect, without adding new parts, injection abnormality not only when fuel injection is not performed but also including fuel injection in a state where the injection quantity has fallen abnormally low. In a state where a flow rate control valve is controlled in a closed loop, a pressure control valve is controlled in an open loop and an indicated injection quantity of fuel that should be injected from fuel injection valves arithmetically calculated by predetermined arithmetic processing on the basis of the operating state of an engine exceeds zero, when it has been determined that the difference between a minimum fuel through-flow rate in the flow rate control valve determined by a predetermined map from an engine speed Ne and the indicated injection quantity and a fuel through-flow rate decided in closed loop control of the flow rate control valve is larger than a predetermined threshold value K, it is determined there is injection abnormality.

7 Claims, 3 Drawing Sheets

(56) References Cited

U.S. PATENT DOCUMENTS

| | | | | |
|---|---|---|---|---|
| 7,779,819 | B2 * | 8/2010 | Serra et al. | 123/514 |
| 8,050,845 | B2 * | 11/2011 | Katsura | 701/103 |
| 8,108,124 | B2 * | 1/2012 | Jung et al. | 701/104 |
| 8,240,290 | B2 * | 8/2012 | Miyake et al. | 123/446 |
| 2004/0103883 | A1 | 6/2004 | Geyer | |
| 2006/0249120 | A1 * | 11/2006 | Semii et al. | 123/446 |
| 2007/0023009 | A1 * | 2/2007 | Elliott et al. | 123/446 |
| 2007/0079808 | A1 * | 4/2007 | Takahashi | 123/447 |
| 2010/0275679 | A1 * | 11/2010 | Wang et al. | 73/114.42 |

FOREIGN PATENT DOCUMENTS

| | | | |
|---|---|---|---|
| JP | 2003328830 | A | 11/2003 |
| JP | 2005517120 | A | 6/2005 |
| WO | 2005001280 | A1 | 1/2005 |
| WO | 2005050003 | A1 | 6/2005 |

* cited by examiner

INJECTION ABNORMALITY DETECTION METHOD AND COMMON RAIL FUEL INJECTION CONTROL SYSTEM

BACKGROUND OF THE INVENTION

1. Field of the Invention

The present invention relates to a method of detecting abnormality of fuel injection and to a common rail fuel injection control system and particularly relates to improving the reliability of fuel injection control operation.

2. Description of the Related Art

The present invention pertains to a method of detecting abnormality of fuel injection and to a common rail fuel injection control system and particularly relates to improving the reliability of fuel injection control operation.

Common rail fuel injection control systems have come to be widely employed as systems that control the supply of fuel to internal combustion engines represented by diesel engines, but in recent years, from the viewpoint of realizing higher pressure and higher precision fuel injection control, there have been proposed systems of various configurations, such as a system using a piezo injector using a piezo element as a fuel control valve as disclosed, for example, in JP-A-2007-510849.

Incidentally, in these fuel injection control systems, there is disposed a return fuel passage for returning surplus fuel from fuel injection valves to a fuel tank, and in order to ensure that it does not inhibit injection operation of the fuel injection valves, a pressure holding valve is disposed in the return fuel passage, and the pressure on the return fuel passage side as seen from the fuel injection valves is held at a predetermined pressure or higher as disclosed, for example, in JP-A-2006-523793.

Disposing a pressure holding valve in the return fuel passage from the fuel injection valves is the same even in the system using a piezo injector mentioned previously. Particularly in the case of piezo injectors, piezo injectors employing a configuration where a hydraulic circuit is used in order to amplify the stroke of piezo actuators are common, but in terms of the structure thereof, a little fuel leaks from this hydraulic circuit to the aforementioned return fuel passage per one stroke of injection, so in order to refill with fuel for the next injection, it is necessary to reliably hold the pressure with the pressure holding valve interconnecting the piezo injectors and the return fuel passage.

However, it is common for the aforementioned pressure holding valve to have a mechanical configuration, and it is not the case that some kind of electrical control is applied from the outside, so when a fault arises and the pressure holding valve becomes unable to hold the predetermined pressure, sometimes this leads to injection abnormality such as described next, and that injection abnormality cannot be detected. That is, for example, in a state where the rail pressure is a relatively low pressure, when a fault arises where the pressure holding valve cannot hold the predetermined pressure, there are cases where, rather than fuel injection becoming completely unable to be performed, fuel injection is performed even though the injection quantity is lower than the normal injection quantity. In this case, fuel injection is still being performed even though there is a difference in the injection quantities, and it is not the case that the fault in the pressure holding valve itself is detected, so conventionally, the control system has been unable to determine this state to be one where the injection state is abnormal. In this manner, a phenomenon where fuel injection is performed in a state where the injection quantity has fallen lower than the normal quantity can similarly occur even when a mechanical fault has arisen in the fuel injection valves, and currently there is no technology that reliably detects that.

SUMMARY OF THE INVENTION

The present invention has been made in view of the above-described circumstances and provides an injection abnormality detection method and a common rail fuel injection control system that can reliably detect, without adding new parts, injection abnormality not only when fuel injection is not performed but also including fuel injection in a state where the injection quantity has fallen abnormally low.

According to a first aspect of the invention, there is provided an injection abnormality detection method in a common rail fuel injection control system where fuel in a fuel tank is pressurized and pressure-fed to a common rail by a high pressure pump to enable injection of high pressure fuel to an internal combustion engine via fuel injection valves connected to that common rail, a low pressure control electromagnetic valve is disposed on an upstream side of the high pressure pump, rail pressure control is enabled by drive control of that low pressure control electromagnetic valve, and a pressure holding valve is disposed inside a return fuel passage from the fuel injection valves, the injection abnormality detection method comprising determining there is injection abnormality when, in a state where the low pressure control electromagnetic valve is controlled in a closed loop, the difference between a reference fuel through-flow rate in the low pressure control electromagnetic valve determined in response to the operating state of the engine and a fuel through-flow rate of the low pressure control electromagnetic valve decided in closed loop control of the lower pressure control electromagnetic valve is larger than a predetermined threshold value.

According to a second aspect of the invention, there is a common rail fuel injection control system where fuel in a fuel tank is pressurized and pressure-fed to a common rail by a high pressure pump to enable injection of high pressure fuel to an internal combustion engine via fuel injection valves connected to that common rail, a low pressure control electromagnetic valve is disposed on an upstream side of the high pressure pump, a pressure holding valve is disposed inside a return fuel passage from the fuel injection valves, and the low pressure control electromagnetic valve is driven and controlled by an electronic control unit to enable rail pressure control, wherein the electronic control unit is configured to determine whether or not fuel injection control is in a predetermined state, calculate, when it has been determined that fuel injection control is in the predetermined state, the difference between a reference fuel through-flow rate in the low pressure control electromagnetic valve determined in response to the operating state of the engine and a fuel through-flow rate of the low pressure control electromagnetic valve decided in closed loop control of the low pressure control electromagnetic valve, and determine that there is injection abnormality when the calculated difference is larger than a predetermined threshold value.

DETAILED DESCRIPTION OF THE PREFERRED EMBODIMENTS

An embodiment of the invention will be described below with reference to FIG. 1 to FIG. 3.

It will be noted that the members and arrangements described below are not intended to limit the present invention and can be variously modified within the scope of the gist of the present invention.

First, an example configuration of a common rail fuel injection control system to which an injection abnormality detection method in the embodiment of the present invention is applied will be described with reference to FIG. 1.

Figure 1:
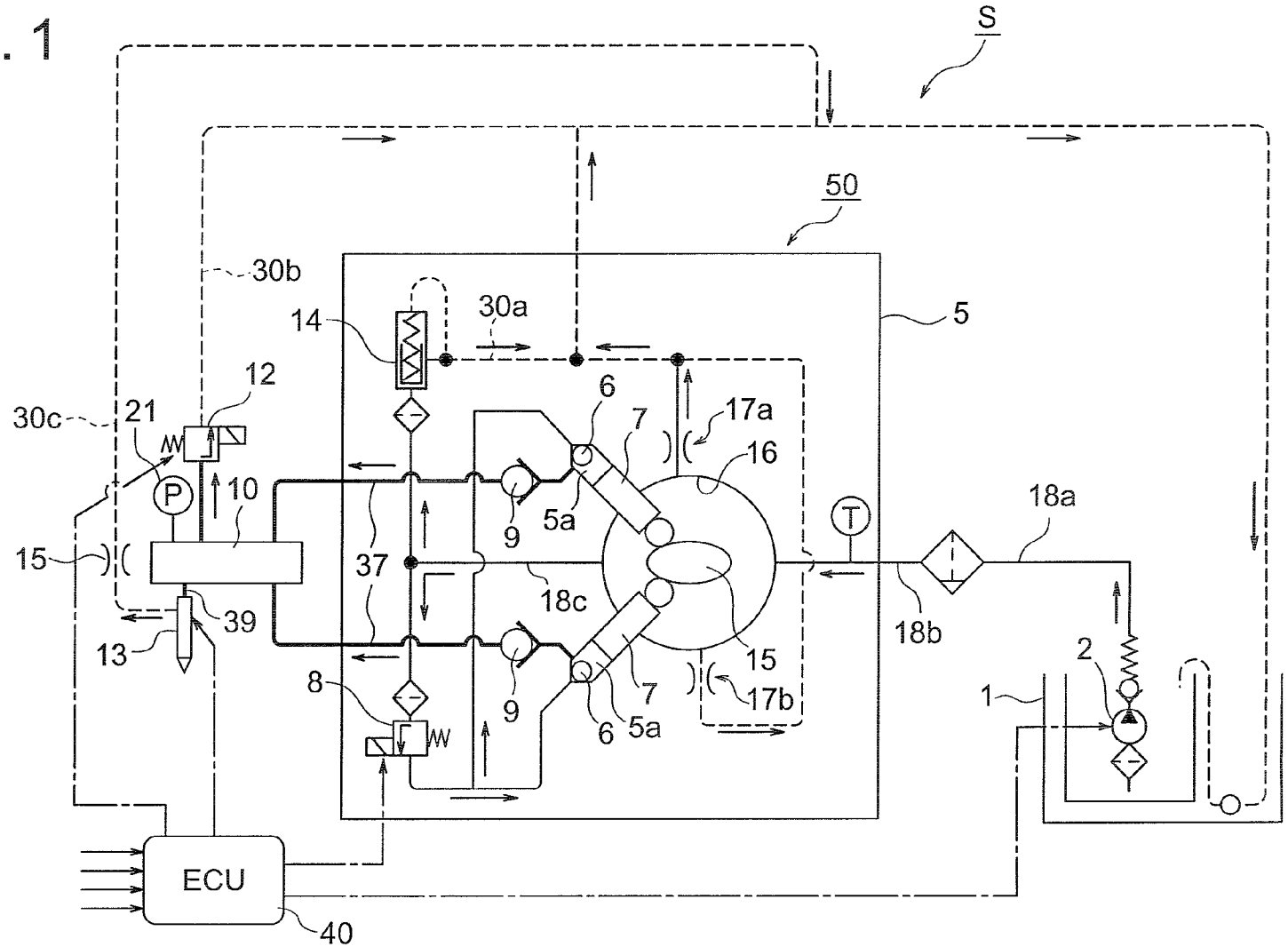
FIG. 1 is a configuration diagram showing an example configuration of a common rail fuel injection control system to which an injection abnormality detection method in an embodiment of the present invention is applied.

A common rail fuel injection control system S shown in FIG. 1 is configured to have as its main configural elements a fuel tank 1 that stores fuel, a low pressure feed pump 2 that supplies the fuel in the fuel tank 1 to a high pressure pump device 50, the high pressure pump device 50 that performs pressure-feeding of high pressure fuel, a common rail 10 that accumulates the high pressure fuel that has been pressure-fed by this high pressure pump device 50, plural fuel injection valves 13 that inject and supply the high-pressure fuel that has been supplied from this common rail 10 into cylinders of an unillustrated diesel engine, and an electronic control unit (written as "ECU" in FIG. 1) 40 in which fuel injection control processing and later-described injection abnormality detection processing are executed.

The aforementioned configural elements excluding the electronic control unit 40 are interconnected by fuel passages; in FIG. 1, a high pressure fuel passage 37 is indicated by a fat line, low pressure fuel passages 18*a* to 18*c* are indicated by fine lines, and fuel reflux paths 30*a* to 30*c* are indicated by broken lines, respectively. Further, in FIG. 1, electrical wiring is indicated by one-dotted chain lines.

The low pressure feed pump 2 supplies the fuel stored in the fuel tank 1 to pressurizing chambers 5*a* of a high pressure pump 5 via the low pressure fuel passages 18*a* to 18*c*. An electromagnetic low pressure pump is used for the low pressure feed pump 2 in the embodiment of the present invention, and the low pressure feed pump 2 is configured to pressure-feed low pressure fuel of a predetermined flow rate by energization control by the electronic control unit 40.

The high pressure pump device 50 is configured to have as its main configural elements the high pressure pump 5, a flow rate control valve 8, and a pressure regulation valve 14.

The high pressure pump 5 pressurizes with plungers 7 the low pressure fuel that has been pressure-fed by the low pressure feed pump 2 and introduced to the pressurizing chambers 5*a* via fuel suction valves 6 and pressure-feeds the high pressure fuel to the common rail 10 via fuel discharge valves 9 and the high pressure fuel passage 37.

The high pressure pump 5 in the embodiment of the present invention is configured such that the low pressure fuel sent from the fuel tank 1 via the low pressure fuel passages 18*a* and 18*b* into the high pressure pump 5 is first allowed to flow into a cam chamber 16 and is then introduced from there via the low pressure fuel passage 18*c* to the pressurizing chambers 5*a*.

Further, the electromagnetic flow rate control valve (low pressure control electromagnetic valve) 8 is disposed in the low pressure fuel passage 18*c* interconnecting the cam chamber 16 and the pressurizing chambers 5*a*, is driven and controlled by the electronic control unit 40 in response to the required rail pressure and the required injection quantity, adjusts the flow rate of the low pressure fuel, and can deliver the low pressure fuel to the pressurizing chambers 5*a*.

On the upstream side of the flow rate control valve 8, the pressure regulation valve 14 branches from and is connected to the low pressure fuel passage 18*c* and is disposed in parallel to the flow rate control valve 8, and the pressure regulation valve 14 is further connected to the fuel reflux path 30*a* leading to the fuel tank 1.

This pressure regulation valve 14 uses an overflow valve that opens when the differential pressure in front and in back thereof—that is, the difference between the pressure inside the low pressure fuel passages 18*a* to 18*c* and the cam chamber 16 and the pressure inside the fuel reflux path 30*a* on the fuel tank 1 side of the pressure regulation valve 14—exceeds a predetermined value.

For this reason, in a state where the low pressure fuel is being pressure-fed by the low pressure feed pump 2, the pressure inside the low pressure fuel passages 18*a* to 18*c* and the cam chamber 16 is kept to be larger by a predetermined differential pressure than the pressure inside the fuel reflux path 30*a*.

The plural fuel injection valves 13 are connected via a high pressure fuel passage 39 to the common rail 10, and the high pressure fuel that has been pressure-fed from the high pressure pump 5 and accumulated is supplied to each of the fuel injection valves 13.

A rail pressure sensor 21 and a pressure control valve (high pressure control electromagnetic valve) 12 are attached to this common rail 10.

An electromagnetic proportional control valve, for example, is used for the pressure control valve 12, and the pressure control valve 12 can adjust the quantity in which it releases some of the high pressure fuel accumulated in the common rail 10 to the fuel reflux path 30*b*, whereby the pressure control valve 12 can reduce the pressure inside the common rail 10.

A signal of the actual rail pressure that has been detected by the rail pressure sensor 21 is inputted to the electronic control unit 40 and is supplied for drive control of the flow rate control valve 8 and the pressure control valve 12 performed such that the actual rail pressure becomes a target rail pressure.

Publicly-known electromagnetically controlled valves or piezo valves are used for the fuel injection valves 13, drive control thereof is performed by the electromagnetic control unit 40, and the high pressure fuel is injected into cylinders of an unillustrated internal combustion engine. Return fuel from the fuel injection valves 13 is returned to the fuel tank 1 via a pressure holding valve 15 and the fuel reflux path 30*c* (return fuel passage).

Here, the pressure holding valve 15 is a so-called mechanical valve and is configured such that it opens at a predetermined pressure.

When this pressure holding valve 15 has failed, in a worst case scenario, sometimes fuel injection is no longer performed, but sometimes there is not just a case where fuel injection becomes impossible but also a state where fuel injection is performed even though the injection quantity has fallen lower than the normal quantity. Such injection abnormality can arise even in a case where the fuel injection valves 13 have mechanically failed, and in the embodiment of the present invention, such injection abnormality can be detected by injection abnormality detection processing executed in the electronic control unit 40 as described later.

The electronic control unit 40 has, for example, mainly a microcomputer (not shown) comprising a publicly-known/well-known configuration and storage elements (not shown) such as a RAM and a ROM and is configured to have as its main configural elements a drive circuit (not shown) for driving the fuel injection valves 13 and an energization circuit (not shown) for performing energization of the flow rate control valve 8 and the pressure control valve 12.

The detection signal of the rail pressure sensor 21 is inputted to this electronic control unit 40 as mentioned previously, and various types of detection signals such as the engine speed and the accelerator pedal position are also inputted to the electronic control unit 40 so that they are supplied for operation control of the unillustrated engine and fuel injection control.

Next, rail pressure control performed in the common rail fuel injection control system of this configuration will be generally described.

In the embodiment of the present invention, control of the rail pressure is performed by the flow rate control valve 8 and the pressure control valve 12.

Rail pressure control by the pressure control valve 12 can directly control the rail pressure by adjusting the quantity of the high pressure fuel released from the common rail 10, and rail pressure control by the flow rate control valve 8 controls the rail pressure by adjusting the quantity of the low pressure fuel supplied to the pressurizing chambers 5*a* of the high pressure pump 5 to thereby adjust the pressure-feed quantity of the high pressure fuel to the common rail 10.

In the embodiment of the present invention, the electronic control unit 40 utilizes the difference in rail pressure control by the flow rate control valve 8 and the pressure control valve 12 such that, as described next, first to third control modes are appropriately selected in response to the running condition of the unillustrated engine and rail pressure control is performed.

First, to describe the second control mode, in this control mode the flow rate control valve 8 is controlled in an open loop and the pressure control valve 12 is controlled in a closed loop.

The flow rate of the low pressure fuel adjusted by the flow rate control valve 8 and supplied to the pressurizing chambers 5*a* is stipulated in response to the speed of the high pressure pump 5, so the high pressure fuel pressurized to a high pressure inside the pressurizing chambers 5*a* is pressure-fed to the common rail 10 quantitatively in response to the speed of the high pressure pump 5.

Further, the quantity of the low pressure fuel supplied to the pressurizing chambers 5*a* of the high pressure pump 5 is set so as to become equal to or greater than a flow rate that is necessary in order for the flow rate of the high pressure fuel pressure-fed to the common rail 10 to achieve the target rail pressure.

Additionally, the opening degree of the pressure control valve 12 is feedback-controlled by the electronic control unit 40 on the basis of the actual rail pressure that has been detected by the rail pressure sensor 21, and a predetermined quantity of the high pressure fuel is released from the common rail 10, whereby the actual rail pressure is regulated to the target rail pressure.

This second control mode has excellent rail pressure control responsiveness because the rail pressure is directly controlled by the pressure control valve 12. Further, there is also the advantage that it is easy to raise the fuel temperature because a relatively large quantity of the high pressure fuel is pressure-fed quantitatively to the common rail. However, because the control is control that supplies a large quantity of the high pressure fuel to the common rail 10 and releases some of the high pressure fuel from the pressure control valve 12, it is easy for fuel consumption to become inefficient, and for that reason this second control mode is performed at the time of startup of the unillustrated engine and in a state where the fuel temperature is falling.

Next, to describe the third control mode, this control mode is one where the flow rate control valve 8 is controlled in a closed loop and the pressure control valve 12 is controlled in an open loop.

In this third control mode, the pressure control valve 12 is placed in a completely closed state, and release of the high pressure fuel via the pressure control valve 12 from the common rail 10 is not performed, so rail pressure control by this pressure control valve 12 is substantially not performed.

On the other hand, the valve opening degree of the flow rate control valve 8 is feedback-controlled on the basis of the actual rail pressure, and the flow rate of the high pressure fuel pressure-fed to the common rail 10 is adjusted, whereby the flow rate control valve 8 is controlled such that the actual rail pressure becomes the target rail pressure.

In this third control mode, the flow rate of the high pressure fuel pressure-fed to the common rail 10 is adjusted by controlling the flow rate of the low pressure fuel supplied to the pressurizing chambers 5*a*, so the efficiency of fuel consumption is improved without increasing the drive torque more than necessary because the necessary quantity of the high pressure fuel can be pressure-fed to the common rail 10 when necessary.

In this third control mode, rail pressure control responsiveness when the rail pressure has been rapidly decreased is inferior as compared to the second control mode because a time difference arises from after the valve opening degree of the flow rate control valve 8 is changed until the rail pressure fluctuates.

As a control mode that utilizes the characteristics of the second and third control modes and compensates for the shortcomings of both, there is the first control mode.

That is, in the first control mode, the flow rate control valve 8 and the pressure control valve 12 are both controlled in a closed loop, and the flow rate of the high pressure fuel pressure-fed to the common rail 10 and the quantity of the high pressure fuel released from the common rail 10 are adjusted with good balance, so that the burden of rail pressure control can be dispersed.

The injection abnormality detection method in the embodiment of the present invention enables detection of injection abnormality in a case where fuel injection is no longer performed for whatever reason and in a case where fuel injection is performed but the injection quantity thereof is falling extremely low from the normal injection quantity.

The injection abnormality detection method in the embodiment of the present invention is suited for performing particularly when rail pressure control is in the third control mode; in FIG. 2, there is shown a functional block diagram functionally expressing the general relationship between the third control mode and injection abnormality detection processing executed in the embodiment of the present invention, and the content thereof will be described below with reference to the same drawing.

First, the third control mode is a control mode where the flow rate control valve 8 is controlled in a closed loop and the pressure control valve 12 is controlled in an open loop, and the third control mode performs control of the rail pressure indirectly by regulating the quantity of fuel supplied to the pump 5 by the flow rate control valve 8.

The quantity of fuel supplied to the pump 5 by the flow rate control valve 8 (hereinafter called "the flow rate control valve indicated flow rate") is decided in consideration of variations in the operating characteristics of the system on a pre-control quantity decided by a predetermined map (a pre-control MAP) from an engine speed Ne and an indicated injection quantity Q (see FIG. 2).

That is, first, in the electronic control unit 40, there is stored a pre-control MAP that determines a pre-control quantity from the engine speed Ne and the indicated injection quantity Q. Here, the pre-control quantity is a quantity of fuel supplied to the pump 5 by the flow rate control valve 8 determined by the engine speed Ne and the indicated injection quantity Q.

Further, the indicated injection quantity Q is a quantity of fuel that should be injected from the fuel injection valves 13, which is arithmetically calculated by predetermined arithmetic processing on the basis of the operating state of the unillustrated engine.

The pre-control MAP is determined by simulation in consideration of a PI constant in later-described PI control (proportional-integral control) and changes in rail pressure on the basis of the engine speed Ne and the indicated injection quantity Q, but individual pre-control quantities are set to slightly smaller values than the necessary fuel quantity that has been obtained by simulation. In this manner, the reason for making individual pre-control quantities slightly smaller values than the necessary fuel quantity that has been obtained by simulation is to ensure that the deficiency is compensated by PI control as described next.

The deficiency in the pre-control quantity that has been obtained as described above is compensated by PI control.

That is, PI control (proportional-integral control) is performed on the basis of the difference between the target rail pressure arithmetically calculated by predetermined arithmetic processing on the basis of the operating state of the unillustrated engine and the actual pressure that has been detected by the rail pressure sensor 21, and the control result thereof is added to the pre-control quantity, whereby there is obtained a flow rate control valve indicated flow rate $\alpha$ where the quantity of fuel that is deficient by just the value of the pre-control quantity has been compensated.

Moreover, in the electronic control unit 40, the correlation (flow rate/current characteristic) between the flow rate control valve indicated flow rate $\alpha$ and an energization current value (energization quantity) of the flow rate control valve 8 (hereinafter called "the flow rate control valve indicated current") is stored as a map, and with respect to the flow rate control valve indicated flow rate $\alpha$ that has been obtained as described above, the magnitude of a current I that should energize the flow rate control valve 8 is decided from the flow rate/current characteristic thereof, and that current I is passed through the flow rate control valve 8 by an unillustrated energization drive circuit.

On the other hand, in the electronic control unit 40, there is stored a map (hereinafter called "the essential supply quantity map") in which are determined minimum quantities of fuel that should be supplied to the high pressure pump 5 by the flow rate control valve 8 in different cases with respect to various combinations of the engine speed Ne and the indicated injection quantity Q.

Additionally, each time the engine speed Ne and the indicated injection quantity Q are inputted, a minimum quantity $\beta$ of fuel (reference fuel through-flow rate) that should be supplied to the high pressure pump 5 under that engine speed Ne and indicated injection quantity Q is read by the essential supply quantity map, injection abnormality detection processing described next is executed on the basis of the difference with the flow rate control valve indicated flow rate $\alpha$, and injection abnormality is detected.

Figure 3:
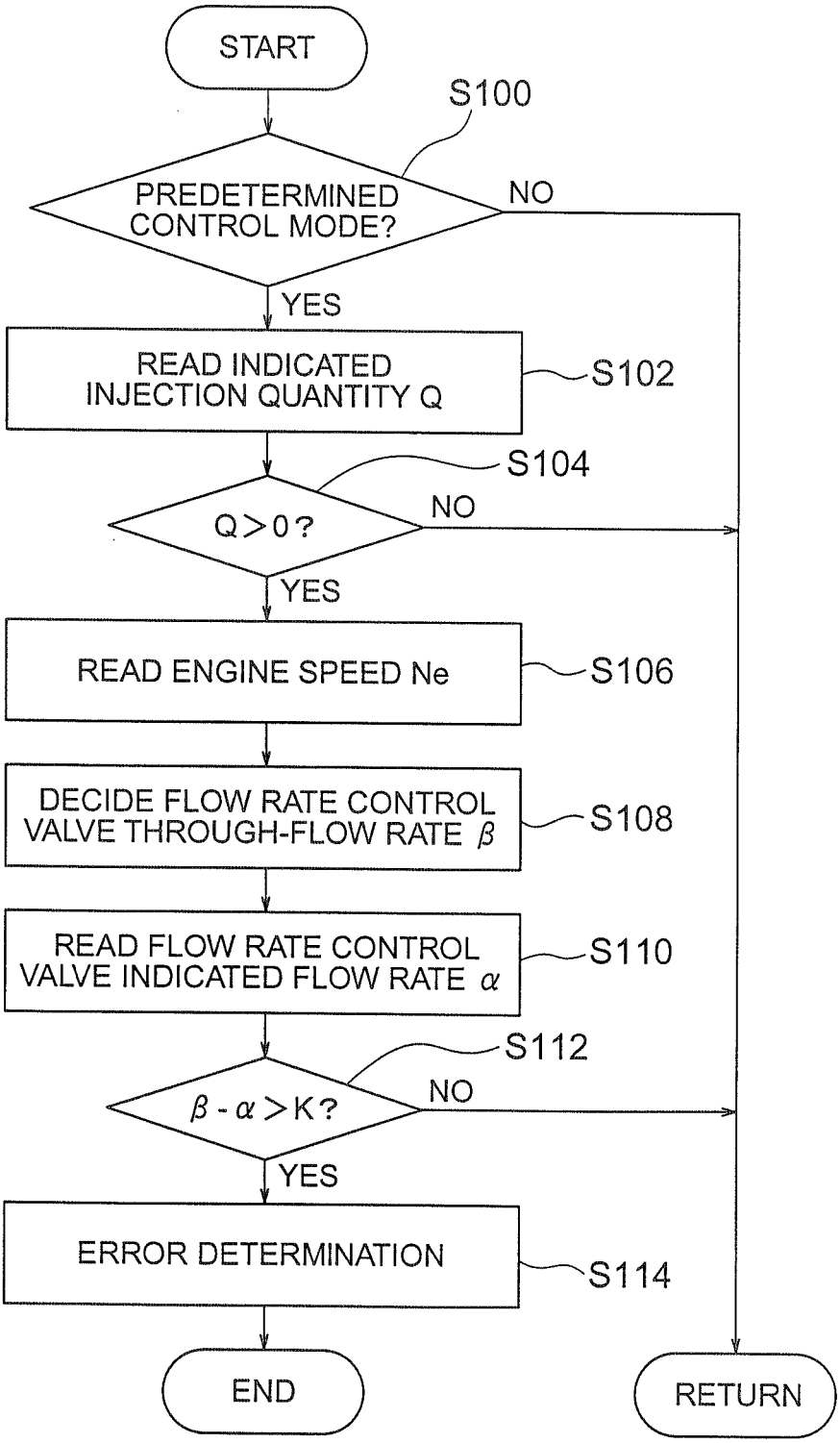
FIG. 3 is a sub-routine flowchart showing a procedure of injection abnormality detection processing executed by an electronic control unit configuring the common rail fuel injection control system shown in FIG. 1.

In FIG. 3, there is shown a sub-routine flowchart showing a procedure of injection abnormality detection processing executed in the electronic control unit 40, and the content thereof will be described below with reference to the same drawing.

When processing is started, first, it is determined whether or not rail pressure control is in a predetermined control mode suited for performing injection abnormality detection (see step S100 in FIG. 3). Here, the predetermined control mode specifically is the third control mode described previously.

Determination resulting from a flag is suitable for the determination of whether or not rail pressure control is in the third control mode.

That is, in an unillustrated main routine, the third control mode described previously is selectively executed as rail pressure control, but ordinarily flag setting is performed in response to the control mode in order to clarify which control mode is being executed, so it is suitable to use that flag to determine whether or not rail pressure control is in the third control mode.

Then, in step S100, when it has been determined that rail pressure control is not in the third control mode (in the case of NO), rail pressure control is not suited for performing the processing below, so the series of processing is ended, the sub-routine returns to the unillustrated main routine, other processing is performed, and thereafter the processing shown in FIG. 3 is again executed at a predetermined timing.

On the other hand, in step S100, when it has been determined that rail pressure control is in the third control mode (in the case of YES), the indicated injection quantity Q is read (see step S102 in FIG. 3).

Here, the indicated injection quantity Q is a quantity of fuel that should be injected from the fuel injection valves 13 arithmetically calculated by predetermined arithmetic processing on the basis of the operating state of the unillustrated engine, and this arithmetic processing is executed in the unillustrated main routine; here, the arithmetic result thereof is read and used.

Next, it is determined whether or not the indicated injection quantity Q exceeds zero (see step S104 in FIG. 3), and when it has been determined that the indicated injection quantity Q does not exceed zero (in the case of NO), it is determined that rail pressure control is not suited for executing the processing below and the series of processing is temporarily ended.

On the other hand, in step S104, when it has been determined that the indicated injection quantity Q exceeds zero (in the case of YES), the engine speed Ne is read (see step S106 in FIG. 3).

Here, the engine speed Ne is, like the indicated injection quantity, used in the unillustrated main routine, and in step S106, it is read and used.

Next, the minimum quantity supplied to the high pressure pump 5 decided with respect to the indicated injection quantity Q and the engine speed Ne that have been obtained as described above—in other words, the through-flow rate $\beta$ (reference fuel through-flow rate) of the flow rate control valve 8—is obtained using the predetermined essential supply quantity map (see step S108 in FIG. 3).

Here, the essential supply quantity map is, as mentioned previously, a map in which are determined minimum quantities of fuel that should be supplied to the high pressure pump 5 by the flow rate control valve 8 in different cases with respect to various combinations of the engine speed Ne and the indicated injection quantity Q.

Next, the flow rate control valve indicated flow rate α is read (see step S110 in FIG. 3). That is, as mentioned previously, the flow rate control valve indicated flow rate α calculated in unillustrated rail pressure control processing is read.

Then, it is determined whether or not the difference between the flow rate control valve through-flow rate β and the flow rate control valve indicated flow rate α (flow rate control valve through-flow rate β−flow rate control valve indicated flow rate α) exceeds a predetermined threshold value K (see step S112 in FIG. 3).

In step S112, when it has been determined that (flow rate control valve through-flow rate β−flow rate control valve indicated flow rate α) exceeds the predetermined threshold value K (in the case of YES), it is determined that there is an error, that is, that injection abnormality is occurring, for example, alarm issuance or abnormality display is appropriately performed by the electronic control unit 40, and the series of processing is ended (see step S114 in FIG. 3).

Here, injection abnormality in the embodiment of the present invention is a concept including both a state where fuel injection is not performed for whatever reason and a state where fuel injection is performed but the injection quantity falls abnormally low.

The reason it is determined that there is an error when β−α>K is true in this manner is because this means that a state where β−α>K is true is a state where the quantity of fuel supplied to the high pressure pump 5 by the flow rate control valve 8—in other words, the through-flow rate α of the flow rate control valve 8—is equal to or less than the minimum quantity β that should normally exist in a normal injection state, and it can be considered that injection abnormality is arising for whatever reason.

That is, for example, in a state where a mechanical fault has arisen in the pressure holding valve 15 or the fuel injection valves 13 and fuel injection by the fuel injection valves 13 is not performed or in a state where fuel injection is performed but the injection quantity thereof has fallen extremely low, the quantity of fuel outputted from the common rail 10 falls and the rail pressure rises. With respect thereto, the PI control (see FIG. 2) mentioned previously acts to lower the rail pressure, so the flow rate control valve indicated flow rate α becomes smaller. Consequently, it can be determined that there is injection abnormality by capturing the extent of the decrease in the flow rate control valve indicated flow rate α, and injection abnormality detection in the embodiment of the present invention takes this viewpoint.

Processing of error determination (step S114 in FIG. 3) is suitable even when it is executed when it has been determined in step S112 that β−α>K is true and that state has continued for a predetermined amount of time.

On the other hand, in step S112, when it has been determined that β−α>K is not true (in the case of NO), it is regarded that there is no injection abnormality, the series of processing is ended, the sub-routine returns to the unillustrated main routine, other processing is executed, and thereafter the processing shown in FIG. 3 is again executed at a predetermined timing.

Figure 2:
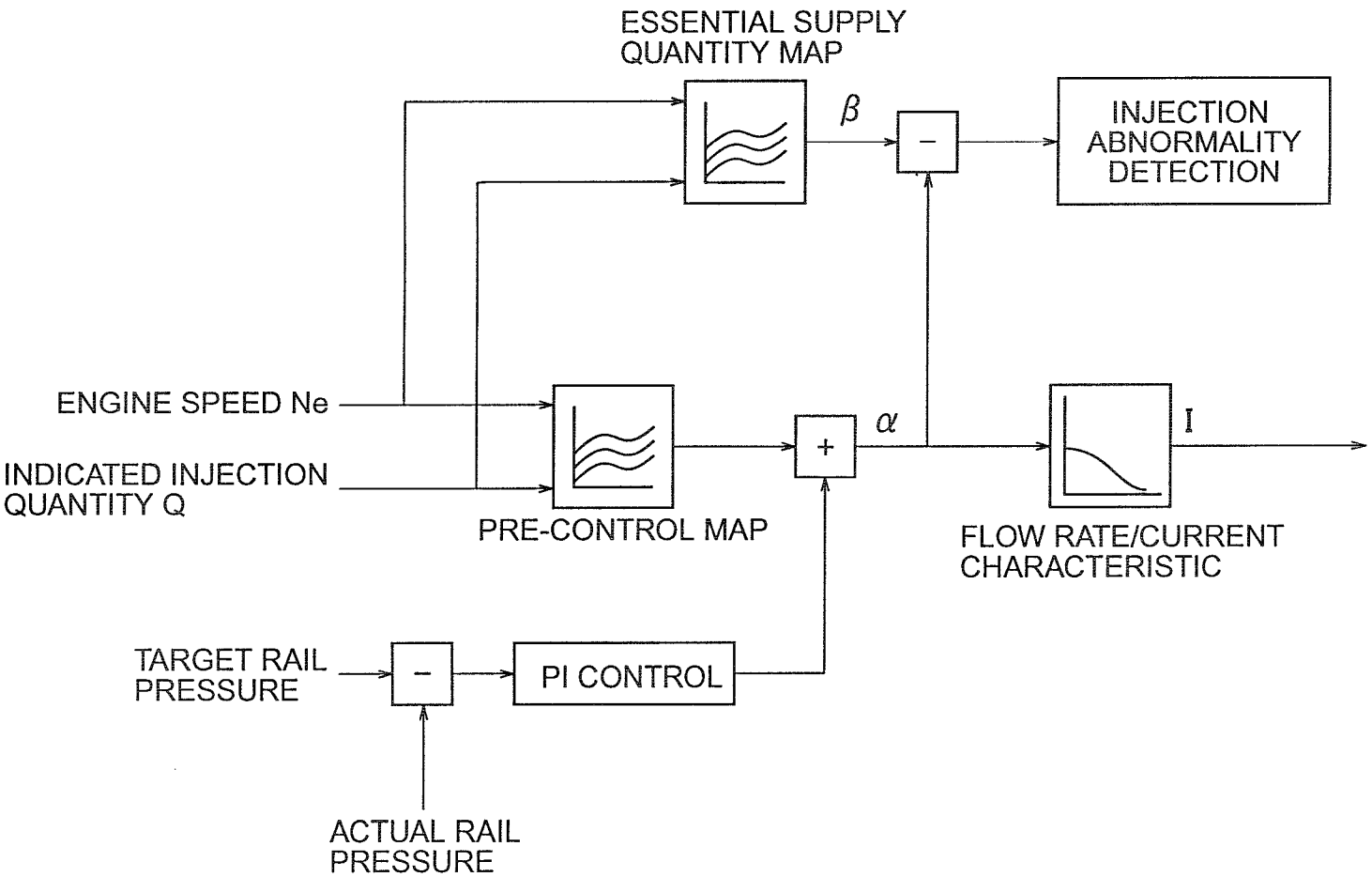
FIG. 2 is a functional block diagram functionally expressing the general relationship between a third control mode and injection abnormality detection processing in rail pressure control executed in the common rail fuel injection control system shown in FIG. 1.

In the example configuration described above, the invention has been configured to use, as the reference fuel through-flow rate, the minimum quantity of fuel (flow rate control valve through-flow rate) β that should be supplied to the high pressure pump 5 by the flow rate control valve 8 in different cases with respect to various combinations of the engine speed Ne and the indicated injection quantity Q as a comparison target for determining whether or not the flow rate control valve indicated flow rate α is normal, but instead of this, for example, the invention may also be configured to use the flow rate obtained by the pre-control map described in FIG. 2. This is because, when injection abnormality is arising, the flow rate control valve indicated flow rate α, which is a flow rate where the pre-control quantity is tinged with PI control of the operating characteristics of the system, becomes smaller than the pre-control quantity itself.

In the embodiment of the present invention described above, as the state of rail pressure control suited for executing injection abnormality detection processing, the third control mode has been described as being appropriate (see step S100 in FIG. 3), but basically it suffices for the state to be one where the flow rate control valve 8 is being controlled in a closed loop. Consequently, specifically, the injection abnormality detection processing in the embodiment of the present invention can also be applied to a case where, for example, in a fuel injection control system that is equipped with the flow rate control valve 8 and the pressure control valve 12 and is configured to selectively perform closed loop control of the flow rate control valve 8 and closed loop control of the pressure control valve 12, the flow rate control valve 8 is in a state where it is being controlled in a closed loop.

Further, the injection abnormality detection processing in the embodiment of the present invention can also be applied to a fuel injection control system that has only the flow rate control valve 8 and is configured to perform rail pressure control with closed loop control thereof.

This invention makes it possible to detect, without adding new parts, not only a faulty state where injection is not performed but also an injection state where injection is abnormal even though there is injection, so the invention can be applied particularly in a fuel injection control system with a simple configuration where high-reliability fuel injection control is demanded in fuel injection control.

According to the present invention, the invention is configured to use the through-quantity of the fuel in the low pressure control electromagnetic valve for injection abnormality detection, so the invention achieves the effects that it can reliably detect, without adding new parts, not only a case where fuel injection is not performed but also an abnormal injection state where the injection quantity has fallen abnormally low and can contribute to improving reliability.

Further, unlike conventionally, the invention achieves the effects that it can warn and inform the driver of that injection abnormality and can contribute to improving drivability.

What is claimed is:

1. An injection abnormality detection method in a common rail fuel injection control system where fuel in a fuel tank is pressurized and pressure-fed to a common rail by a high pressure pump to enable injection of high pressure fuel to an internal combustion engine via fuel injection valves connected to the common rail, a low pressure control electromagnetic valve is disposed on an upstream side of the high pressure pump, rail pressure control is enabled by drive control of the low pressure control electromagnetic valve, and a pressure holding valve is disposed inside a return fuel passage from the fuel injection valves, the injection abnormality detection method comprising determining there is injection abnormality when, in a state where the low pressure control electromagnetic valve is controlled in a closed loop, the difference between a reference fuel through-flow rate in the low pressure control electromagnetic valve determined in response to the operating state of the engine and a fuel through-flow rate of the low pressure control electromagnetic valve decided in closed loop control of the lower pressure control electromagnetic valve is larger than a predetermined threshold value.

2. The injection abnormality detection method according to claim 1, wherein the reference fuel through-flow rate is a minimum fuel through-flow rate in the low pressure control electromagnetic valve determined in response to the operating state of the engine.

3. The injection abnormality detection method according to claim 2, wherein the method decides the minimum fuel through-flow rate in the low pressure control electromagnetic valve using a predetermined map, and the map is a map in which are stipulated minimum fuel through-quantities in the low pressure control electromagnetic valve with respect to various combinations of engine speeds and injection quantities of the fuel injection valves arithmetically calculated by a predetermined arithmetic expression in response to the operating state of the engine.

4. A common rail fuel injection control system where fuel in a fuel tank is pressurized and pressure-fed to a common rail by a high pressure pump to enable injection of high pressure fuel to an internal combustion engine via fuel injection valves connected to the common rail, a low pressure control electromagnetic valve is disposed on an upstream side of the high pressure pump, a pressure holding valve is disposed inside a return fuel passage from the fuel injection valves, and the low pressure control electromagnetic valve is driven and controlled by an electronic control unit to enable rail pressure control, wherein the electronic control unit is configured to determine whether or not fuel injection control is in a predetermined state, calculate, when it has been determined that fuel injection control is in the predetermined state, the difference between a reference fuel through-flow rate in the low pressure control electromagnetic valve determined in response to the operating state of the engine and a fuel through-flow rate of the low pressure control electromagnetic valve decided in closed loop control of the low pressure control electromagnetic valve, and determine that there is injection abnormality when the calculated difference is larger than a predetermined threshold value.

5. The common rail fuel injection control system according to claim 4, wherein the electronic control unit is configured to determine that fuel injection control is in the predetermined state when the low pressure control electromagnetic valve is being controlled in a closed loop.

6. The common rail fuel injection control system according to claim 5, wherein the reference fuel through-flow rate is a minimum fuel through-flow rate in the low pressure control electromagnetic valve determined in response to the operating state of the engine.

7. The common rail fuel injection control system according to claim 6, wherein the system decides the minimum fuel through-flow rate in the low pressure control electromagnetic valve using a predetermined map, and the map is a map in which are stipulated minimum fuel through-quantities in the low pressure control electromagnetic valve with respect to various combinations of engine speeds and injection quantities of the fuel injection valves arithmetically calculated by a predetermined arithmetic expression in response to the operating state of the engine.

* * * * *